United States Patent [19]

Eklund et al.

[11] Patent Number: 4,483,913

[45] Date of Patent: Nov. 20, 1984

[54] PLANOGRAPHIC PRINTING PLATE

[75] Inventors: Nils Eklund, Croton-on-Hudson; Jen-chi Huang, Ossining, both of N.Y.

[73] Assignee: Polychrome Corporation, Yonkers, N.Y.

[21] Appl. No.: 514,408

[22] Filed: Jul. 18, 1983

[51] Int. Cl.[3] ..... G03C 1/78

[52] U.S. Cl. ..... 430/160; 430/161; 430/275; 430/276; 430/278; 430/525; 430/300

[58] Field of Search ..... 430/275, 276, 278, 160, 430/525, 161, 300

[56] References Cited

U.S. PATENT DOCUMENTS

| | | | |
|---|---|---|---|
| 2,694,639 | 11/1954 | Nadeau et al. | 430/525 |
| 2,714,066 | 7/1955 | Jewett et al. | 430/276 |
| 2,882,153 | 4/1959 | Cohn | 430/276 |
| 3,161,517 | 12/1964 | Doggett | 430/276 |
| 3,549,365 | 12/1970 | Thomas | 430/160 |
| 4,343,894 | 8/1982 | Minamizono et al. | 430/528 |
| 4,362,812 | 12/1982 | Minamizono et al. | 430/528 |

*Primary Examiner*—Jack P. Brammer

[57] ABSTRACT

An improved planographic printing plate comprised of a metal substrate, a sealing layer, an interlayer formed from a monomer or polymer of an organic compound having at least one cationic, quaternary sustituted ammonium group, and a photosensitive layer on the surface of the interlayer. The printing plates are water developable and characterized by cleaner non-imaging areas during printing operations. The method of preparing such planographic printing plates is also described and illustrated.

7 Claims, No Drawings

PLANOGRAPHIC PRINTING PLATE

FIELD OF THE INVENTION

Presensitized planographic or lithographic plates utilizing anodized metal substrates, such as anodized aluminum metal which may be grained and/or etched, that have been sealed by a hydrophilic layer, treated to form an interlayer comprising a monomer or polymer of an organic compound having at least one cationic, quaternary substituted ammonium group, and then coated with a photosensitive material such as a diazo compound.

BACKGROUND OF THE INVENTION

In general, photosensitive printing plates are classified as planographic plates, intaglio plates and relief plates. The photosensitive planographic printing plate is produced by rendering the surface of a support hydrophilic by treating the surface either chemically or physically or by coating a hydrophilic polymer on the surface, followed by applying a suitable photosensitive material on the thus prepared hydrophilic surface.

The usual surface treatments include mechanical surface treating, such as brush graining, and chemical surface treating such as electrolytic graining and/or etching, and/or chemical surface treating which applies a further layer such as an alkali metal salt of phosphonic acid, a silicate, and potassium fluorozirconate, with or without anodic oxidation.

Most lithographic plates were once prepared from grained zinc plates which had been coated with a suitable photosensitive composition, dried, promptly exposed to secure the desired image, followed by applying a developing ink to the entire surface of the plate which was then washed with water to eliminate any water-soluble materials and developing ink. A gum arabic solution was thereafter applied to the printing surface of the plate to protect it until it was ready for use. The gum arabic provided chemical protection to the image and was easily washed off with water when it was desired to use the plate.

A planographic printing plate is described in U.S. Pat. No. 2,714,066 formed from a thin metal sheet having at least one surface thereof treated to provide a tightly bonded, thin, preferably inorganic, hydrophilic surface treatment, formed from a solution of an alkali metal silicate, salicyclic acid or other treating agent which would form a permanent hydrophilic scum-preventing and tone-reducing film overlying and in firmly bonded contact with the surface of the plate, and having a coating of a light-sensitive organic material over the thus treated surface. The preferred substrate is an aluminum foil or sheet material which has been cleaned, for example, by immersion in a solution of trisodium phosphate.

U.S. Pat. Nos. 3,511,661 to Rauner, as well as 3,860,426 and 3,920,457 to Cunningham et al., disclose coating anodized aluminum with carboxymethyl cellulose, but not in conjunction with diazo photosensitive layers, and utilizes procedures and additives not required in the present invention. However, Thomas in U.S. Pat. No. 3,549,365 utilizes an interlayer coating comprising derivatives of aromatic sulfonic acids.

The present invention is particularly concerned with presensitized plate systems in which the metal substrate has been prepared for application of the photosensitive material by anodization. A problem with known anodized presensitive plate systems has been the uncleanliness of the non-image areas during printing operations. This is a particularly serious problems with water developable plate systems. The natural porosity of the freshly anodized layers results in the absorption of materials of the photosensitive layer into the oxidized layer if the resulting layers are not sealed rendering the area hydrophobic causing ink and other impurities to adhere to the non-image areas. However, it is well known that the organic nature of the sensitizers, resins, additives and dyes may give rise to a shorter press life when such interlayers are employed.

One attempt to solve the problem addressed here was to treat the anodized presensitized plate with an aqueous solution of polyvinylphosphonic acid. This system retains the high printout and high contrast characteristics of the plate, generally eliminates the staining and generally improves the image deletion, water/ink balance (press tinting), exposure and shelf life. The press life, however, is about 25% reduced mainly due to sealing or interlayering chemicals with poor adhesion between the anodic oxide and the coating in the image area.

As previously set forth, U.S. Pat. No. 3,549,395 discloses the obtention of certain improvements when aromatic sulfonic acids are utilized instead of inorganic sealing or barrier-forming materials. Nevertheless, the patent prefers the use of sublayers and overlayers, and especially prefers both, when utilizing the aromatic sulfonic acids.

It is accordingly the object of this invention to provide a new planographic printing plate in which the non-image dirt problem is significantly overcome without substantially adversely affecting the press life and other desired characteristics of the printing plate.

This and other objects of the invention will become apparent to those skilled in the art from the ensuing description.

SUMMARY OF THE INVENTION

This invention relates to a planographic printing plate and more particularly to a planographic printing plate which is an anodized metal substrate having an interlayer or overlying layer of a monomer or polymer of an organic compound having at least one cationic quaternary substituted ammonium group and a photosensitive layer on the interlayer. The preferred printing plates are water developable.

DETAILED DESCRIPTION OF THE INVENTION

As previously noted, the problem dealt with in the present invention pertains to the undesirability of dirt or contaminants on the non-image areas of planographic plates during printing operations. Not only is this problem overcome by the present invention, but aside from the use of a special interlayer, positioned between sealing or barrier layer and the photosensitive or light sensitive layer, the materials and treatments employed are well known and conventional for the manufacture of planographic printing plates such as lithographic plates. The manufacture of water developable planographic printing plates is especially enhanced by utilizing the present invention.

The substrate used in forming a positive or negative acting lithographic printing plate of the present invention can be any metal substrate which has heretofore been used for this purpose. Among the various support materials which can be utilized are zinc, iron or steel, copper, lead tin, chromium, manganese, tantalum, titanium and preferably aluminum, including aluminum alloys such as the alloys of predominantly aluminum with silicon, iron, zinc, copper, manganese, magnesium, chromium, zirconium and the like. The substrate can be grained if desired in a conventional fashion, chemical etching, electrolytic etching or mechanical graining and then anodized also in the usual manner. For example, an aluminum plate can be anodized by subjecting the plate to anodic oxidation, using the plate as an anode in an aqueous or solvent based acid such as sulfuric acid, oxalic acid, boric acid, phosphoric acid, sulfamic acid, chromic acid, and the like, at 1–80 weight % concentration, an electrolyte temperature of 5°–70° C., a current density of 0.5–60 A/dm$^2$, a voltage of 1–100 volts and a time of 30 seconds to 50 minutes.

For certain purposes it may be advantageous to utilize a grained anodized metal substrate or a substrate which is etched rather than grained or both grained and etched as well as being anodized. The graining may be carried utilizing known procedures such as mechanical graining by contacting, e.g. brushing, the metal substrate with an aqueous slurry of pumice. Etching, on the other hand, may be achieved by the known chemical or electrochemical procedures.

The anodized metal substrate, optionally grained and/or etched, is then sealed again by utilizing conventional procedures such as those mentioned. Especially preferred is treatment with an alkali metal silicate such as sodium silicate which forms a hydrophilic sublayer, as has been practiced for many years by the planographic printing plate industry. It was found, however that by merely coating such a sublayer with photosensitive material the problem of non-image area contamination was not overcome. Even the known use of gums during the development procedure proved unsatisfactory with respect to this problem.

The interlayer or overlying layer is formed from organic compounds having at least one cationic, quarternary substituted ammonium group. The preferred ammonium group is one where none of the substituents are hydrogen. For some purposes, the use of organic compounds having two or more such cationic groups have been found particularly efficacious. In general, organic compounds having the following structural formula:

$$N^{\oplus}R_1R_2R_3R_4X^{\ominus}$$

wherein $R_1$, $R_2$, $R_3$ and $R_4$ are selected from alkyl groups having from 1 to 25 carbon atoms, preferably from 1 to 10 carbon atoms, and aryl groups having from 1 to 20, preferably 1 to 10 carbon atoms. The alkyl and aryl groups may have oxygen, silicon, nitrogen, sulfur, or halogen substituents. It is also intended to encompass compounds containing two or more quaternary ammonium groups having the structure

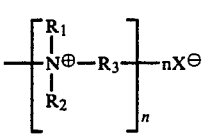

X is an anion which forms a water soluble, hydrophilic salt with the quaternary ammonium compound and n is at least 2. Illustrative anions are chloride, bromide, fluoride, iodide, nitrate, chlorate, acetate, and the like.

It will be further understood that the invention includes the use of unsaturated ammonium compounds that can be polymerized by heat or by irradiation in the presence of suitable and conventional initiators after they have been employed as interlayers.

Specific compounds which are particularly useful in practicing the present invention include, for example, Dimethyldiallylammonium chloride
Hexamethylene bis(trimethylammonium chloride)
Poly(dimethyldiallylammonium chloride)
Poly(N,N-dimethyl-3,5-dimethylenepiperidinium chloride)
1,5-Dimethyl-1,5-diaza undecamethylene polymetho bromide Especially preferred are compounds such as poly(dimethyl diallyl ammonium chloride) or other ammonium polymers that are highly hydrophilic (with a high positive charge density) such as 1,5-dimethyl-1,5-diaza undecamethylene polymetho bromide.

In accordance with another feature of the present invention for preventing ink sensitivity after water development without gum treatment, a group of silicone organic compounds containing alkyl derivatives of ammonia or an amino derivative such as aminopropyltriethoxysilane, etc. can be used effectively as an interlayer for the water developable photosensitive material in preventing ink sensitivity after water development. It was found that aminopropyltriethoxysilane compounds gave a promise functionality in preventing ink sensitivity for a water developable plate and requiring no special gum development. As a silicone compound containing derivatives of ammonium chloride such as N-trimethoxy-silyl propyl-N,N,N-trimethyl ammonium chloride; can be used for the purpose of preventing ink sensitivity. It was found that such compounds can make the non-image area cleaner in a wet inking test after water development and drying. Special gum treatment is then not necessary. It is considered that the derivatives of amino or ammonium chloride are the active functional groups in preventing the ink sensitivity, although the exact mechanism is not fully understood at this time.

The organic monomers or polymers used as the additives of this invention are generally employed in the form of aqueous solutions containing from about 0.01 to 20% of the monomers or polymers. The anodized metal is contacted with the foregoing solution for a time sufficient to form an interlayer, generally about 1 second to 5 minutes. The interlayer is probably little more than a monomolecular layer on the metal substrate. The manner in which the contact is effected is not particularly restricted and the solution can be sprayed on the anodized metal substrate, the substrate can be immersed in the solution or the solution can be roller coated on the substrate, as desired. Following the contacting, the substrate surface is washed or rinsed with water or the other solvent under ambient temperature conditions and dried.

A suitable photosensitive layer is deposited on the interlayered anodized substrate and processed in the conventional fashion. For some purpose, positive type light-sensitive compositions are often o-quinone diazide type light-sensitive materials alone or in combination with appropriate additives. Negative type, lightsensitive diazo materials which can be utilized include water soluble salts of a condensation product of paradiazodiphenyl amine and an aldehyde such as formaldehyde. Also other water soluble aromatic diazonium salts can be utilized. See U.S. Pat. No. 3,929,591 (Chu et al.) and especially columns 7 and 8, the disclosure of which is hereby incorporated by reference.

Upon exposing the light-sensitive plate to actinic radiation through an image-bearing lithographic flat, the diazo type, negative lightsensitive material of the exposed area is transformed into a water or solvent insoluble material forming the image after development with water or a solvent.

The processed plate is ready to be placed on the lithographic press without further treatment and be used in printing or reproducing the desired writings or images. It is customary, however, before placing the plate on a lithographic press to treat the printing surface of the plate with what is known in the art as an "image developer." The image developer can take various forms and one example is a resin emulsion which will adhere to the ink receptive areas but which will not adhere to the hydrophilic areas of the plate. A printer's developing ink can also be used as an image developer. As a result of the interlayer treatment of the present invention, the background staining typically encountered upon the use of conventional inks is substantially avoided. Another posttreatment which is customarily used involves the application to the plate of a gum that will protect it from air oxidation and hydration of anodic oxide by moisture in the air during storage is not necessarily employed in the practice of the present invention.

In order to further illustrate the present invention, various examples are set forth hereunder. In these examples, as well as throughout this specification and claims, all parts and percentages are by weight and all temperatures in degrees Centigrade unless otherwise indicated.

EXAMPLE I (A) A freshly anodized, pumice grained and etched aluminum plate was treated with approximately 2% by weight sodium silicate at a temperature of 75° C. for a period of 45 seconds to form a silicate sealing or barrier sub layer or underlayer. The silicated aluminum plate was rinsed with water, squeeged and dried. Resulting aluminum plate was next dipped for 15 seconds at ambient temperature in a 0.2% aqueous solution of poly(-dimethyldiallylammonium chloride), Agefloc WT by CPS Chemical Corp., to form an interlayer, rinsed with water and dried. A photosensitive top or overlayer was applied to the coated aluminum plate as a water dispersion of a cationic or a nonionic polymer, i.e. Witcobond W-210 (Witco Inc.), in combination with a light sensitive water soluble diazonium salt, i.e. Diazo 8000 (Polychrome Corp.) in an aqueous medium.

The plate was exposed to ultraviolet radiation, developed with water and gummed with a dextrin gum (Gum 963), Polychrome Corp. The plate was dried and again exposed to ultra violet radiation and inked. The nonimage area was clean compared to a similar plate without the interlayer. Furthermore, the use of this interlayer lead to a cleaner plate even when no gum is used.

(B) A run similar to Run A was carried out utilizing 1,5-dimethyl-1,5-diaza undecamethylene polymetho bromide (Polybrene) as the interlayer material. Equally good results were attained.

EXAMPLE II (A) A freshly anodized, pumice grained and etched aluminum plate was treated with 2% sodium silicate (by weight) at a temperature of 75° C. for a period of 60 seconds to form a silicate sealing or barrier sublayer or underlayer. The silicate aluminum sheet was rinsed with water, squeezed and dried. The resulting aluminum plate was next dipped for 15 second at 60° C. in a 0.1% aqueous solution of gamma-amino propyltrimethoxysilane to form the interlayer, rinsed with water and dried. A photosensitive top or overlayer was added by whirl coating the treated aluminum sheet in a dispersion of water soluable Diazo 8000 and a cationic polyurethane, i.e., Witcobond W-210 in water and methanol mixed solvent medium, which coating used in Example I.

The aluminum sheet was dried and exposed to ultraviolet radiation, developed with water. The plate was dried and wet ink tested and was found to be clean compared to a similar plate without the interlayer. If plate was dried after water treatment and again exposed to ultraviolet radiation and wet inked, the non-image area was cleaner than a similar plate without the interlayer.

(B) Example II (A) was repeated except 0.1% N-trimethoxysilylpropyl N,N,N-trimethylammonium chloride was used as an interlayer. Results similar to Run A above were again achieved.

Various changes and modifications can be made in the process and products of this invention without departing from the spirit and scope thereof. The various embodiments which have been disclosed herein were for the purpose of further illustrating the invention but were not intended to limit it.

What is claimed is:

1. A method for preparing a planographic printing plate starting from an anodized, grained and/or etched metal substrate having a hydrophilic sealing layer on at least one surface thereof, which method comprises contacting said starting metal substrate with a solution of a hydrophilic monomer or polymer of an organic compound having at least one cationic, quaternary substituted ammonium group with substituents selected from the group consisting of alkyl groups having from 1–25 carbon atoms and aryl groups having from 1 to 20 carbon atoms, to form an overlying layer, and then coating said overlaying layer with a photosensitive diazo material.

2. The method of claim 1 wherein the metal substrate is an aluminum substrate.

3. The method of claim 1 wherein said hydrophilic sealing layer is a silicate.

4. The method of claim 1 wherein the overlying layer is formed from an organic compound having two such cationic, quaternary substituted ammonium groups.

5. The method of claim 1 wherein said hydrophilic organic monomer or polymer is poly(dimethyldiallylammonium chloride).

6. The method of claim 1 wherein said hydrophilic organic monomer or polymer is 1,5 dimethyl-1,5 diaza undecamethylene polymetho bromide.

7. The method of claim 1 wheren said hydrophilic organic monomer or polymer is dimethyldiallylammonium chloride.

* * * * *